United States Patent [19]

Burns et al.

[11] 4,060,215

[45] Nov. 29, 1977

[54] SLOTTED TOOL HANDLE

[75] Inventors: Fredrick B. Burns, South Milwaukee; Peter Balint, Wauwatosa, both of Wis.

[73] Assignee: E Z Painter Corporation, Milwaukee, Wis.

[21] Appl. No.: 706,075

[22] Filed: July 16, 1976

[51] Int. Cl.[2] ..... A47G 29/00

[52] U.S. Cl. ..... 248/360; 206/362; 211/66; 248/110

[58] Field of Search ..... 248/359, 360, 110; 211/54.1, 57.1, 59.1, 65, 66; 206/362, 362.1, 362.2, 493; 16/110 R; 222/191

[56] References Cited

U.S. PATENT DOCUMENTS

| | | | |
|---|---|---|---|
| 2,467,284 | 4/1949 | Williams | 16/110 R |
| 2,582,006 | 1/1952 | Cedarleaf | 211/66 |
| 2,604,997 | 7/1952 | Pearson | 211/66 |
| 3,432,875 | 3/1969 | Edelson et al. | 248/360 |
| 3,908,949 | 9/1975 | Larson | 248/DIG. 3 X |

*Primary Examiner*—Marion Parsons, Jr.

*Assistant Examiner*—William E. Lyddane

*Attorney, Agent, or Firm*—Mason, Kolehmainen, Rathburn & Wyss

[57] ABSTRACT

A handle for a paint brush or similar tool which facilitates the removal of the paint brush from a display device where the brushes are stacked on a cantilever-type display arm. The paint brush handle includes a generally vertical slot adapted to slidably engage a flat, generally vertically oriented cantilever arm to maintain the brushes in general relative alignment along the arm. The slot in each paint brush handle includes a pair of upwardly converging canted surfaces on the bottom end of the slot to facilitate removal of the brushes from the cantilever arm, for example by a customer desiring to purchase a brush. The paint brush handle may include a hollow interior, or the handle may be solid throughout in which case the canted surfaces terminate in a generally central crown. A generally circular aperture is provided at the upper end of the slot to define a "keyhole" slot so that the brushes also may be displayed on a hanger having a circular cross-section.

9 Claims, 5 Drawing Figures

SLOTTED TOOL HANDLE

BACKGROUND OF THE INVENTION

1. Field of the Invention

This invention relates to paint brush handles and in particular to paint brushes adapted to be displayed by means of a cantilever arm which is flat in a vertical plane and protrudes outwardly from a display panel.

2. Brief Description of the Prior Art

In the past, paint brush hanger displays have been provided which use various geometric cantilever arm configurations for supporting the paint brushes on a display panel. Several of these prior art devices use a circular aperture in the handle and a cantilever arm having a circular cross section and rely on gravity to maintain alignment between the respective brushes. Later designs have utilized a cantilever arm having a relatively thin arm portion which is flat in a vertical plane for engaging a suitably adapted elongated slot in the paint brush handle to assure alignment between the stacked brushes. One example of the later type of hanger is shown in copending patent application Ser. No. 574,705, filed May 5, 1975, and assigned to the assignee of the present invention. It has been found that when customers desire to purchase a paint brush, the paint brush handle sometimes will bind on the hanger arm even when only slightly canted with respect to the arm causing much difficulty and sometimes a loss of a sale.

SUMMARY OF THE INVENTION

An object of the present invention is to provide a novel tool handle which greatly facilitates the removal of the tool from a cantilever type display arm.

In accordance with the above and other objects, the present invention includes the provision of a paint brush handle alone, or in combination with, a generally flat, vertically oriented cantilever display arm. The brush handle is provided with a generally vertical slot (when in elongated hanging condition) adapted to slidably engage the cantilever arm to provide and maintain relative alignment between the respective brushes. A pair of upwardly converging canted surfaces are provided on the bottom end of the slot to prevent binding between the brush handle and the vertically flat cantilever arm when the paint brush is canted relative to the arm during removal or insertion onto the arm. The paint brush handle may be hollow, or may be solid throughout in which case the canted surfaces terminate in a generally central crown. A generally circular hole may be provided at the upper end of the slot to permit the use of the same handle on a different type of cantilever arm having a generally circular cross-section.

Other objects, features and advantages of the invention will be apparent from the following detailed description taken in connection with the accompanying drawings.

DESCRIPTION OF THE PREFERRED EMBODIMENT

Figures 1, 2, 3, 4, 5:
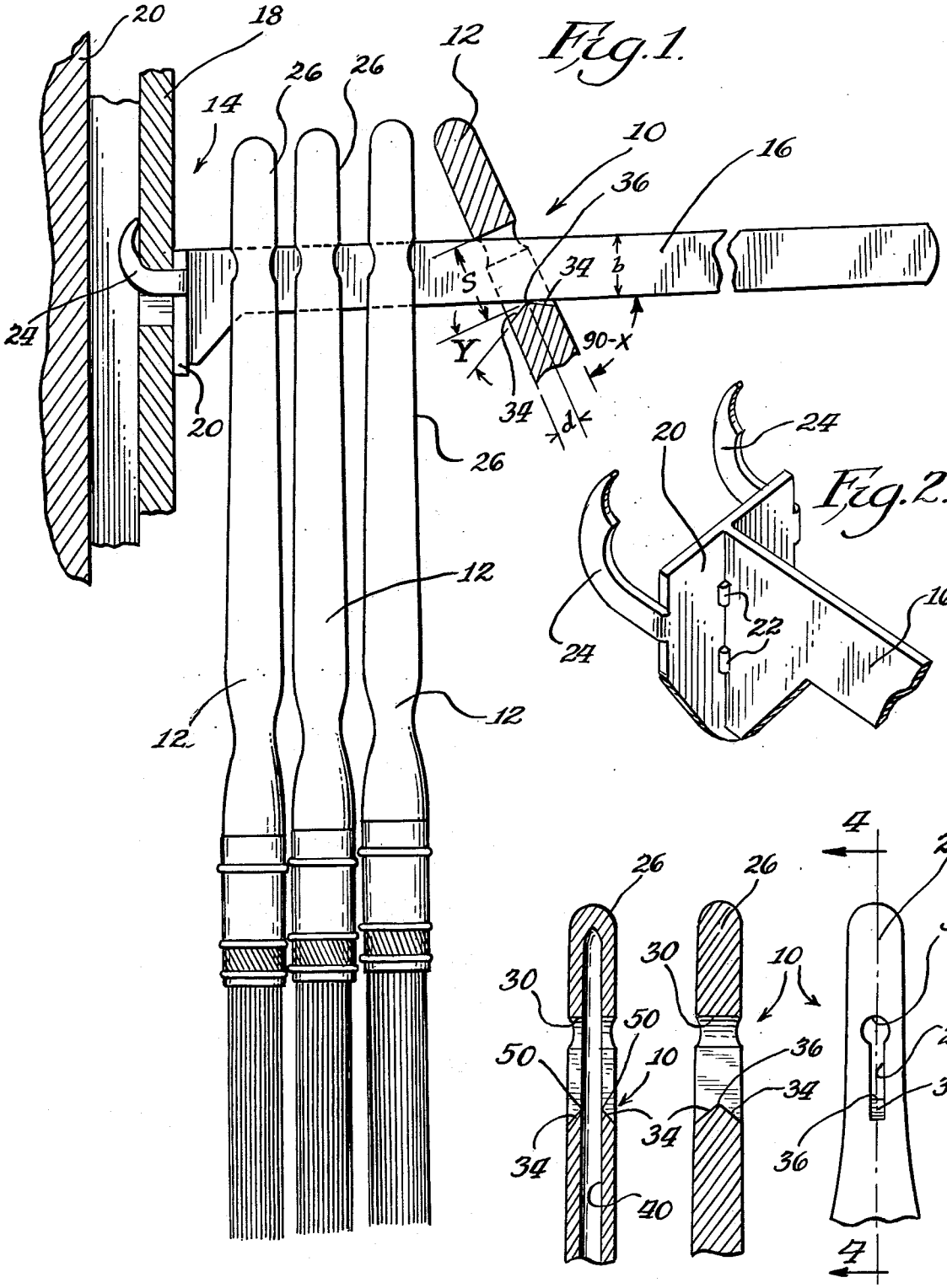
FIG. 1 is a side elevational view, partly in section, showing a plurality of paint brushes, in accordance with the present invention, supported on a vertically flat cantilever arm.
FIG. 2 is a partially fragmented, perspective view, on an enlarged scale, of the cantilever arm attachment means for a pegboard display board.
FIG. 3 is a partially fragmented, front elevational view of a paint brush hanger contemplated by the present invention.
FIG. 4 is a vertical section of a solid paint brush handle taken generally along the line 4—4 of FIG. 3.
FIG. 5 is a vertical section of a hollow paint brush handle similar to FIG. 4.

While the following description of the preferred embodiment relates paticularly to paint brush handles and display racks therefor, it is to be understood that the invention herein is equally applicable to any type of tool or implement such as brooms, or mops, hammers or other articles, and no unnecessary limitations should be understood from the description as it pertains to paint brushes.

The present invention, generally designated 10 in FIGS. 1 and 3 through 5, facilitates the removal of paint brushes 12 from a display device, generally designated 14 in FIG. 1. More particularly, the display device 14 includes a contilevered hanging arm member 16 (FIGS. 1 and 2) which is mounted on a display pegboard 18 secured to a suitable supporting surface 20. The cantilevered hanging arm 16 is generally flat, having a rectangular cross-section with its largest dimension extending in a generally vertical direction. The arm 16 is mounted to a suitable base 20 such as by welding, or crimps 22. The base 20 includes a pair of rearwardly directed hook-shaped flanges 24 which are inserted through apertures in the pegboard 18. The base 20 will support the arm 16 in a slightly upwardly canted orientation which prevents the paint brushes 12 from inadvertently sliding off of the end of the arm 16. Each paint brush handle 26, referring to FIG. 3, includes a generally vertically oriented rectangular aperture or slot 28 which slidably engages the arm 16 to support the paint brushes 12, as shown in FIG. 1. The vertical dimensions of the slot insure and maintain alignment between a plurality of brushes 12 supported on the arm 16 in a generally stacked relationship.

In the preferred embodiment, a circular aperture or hole 30 also is provided at the uppermost end of the slot 28 so that the paint brushes may readily be supported on a rod-type hanger or the like. The combination of the aperture 30 and the slot 28 define a "keyhole" slot for hanging the brushes 12 on any such suitable hangers.

In the past, it has been found that when customers attempt to remove one of the paint brushes 12 from the cantilever arm 16, the bottom edge of the slot 28 tends to engage and bind against the bottom of the cantilever arm, particularly if the paint brush is canted slightly with respect to the arm 16 as shown at the right of FIG. 1. Therefore, in order to avoid this binding and to facilitate removal of a paint brush, a pair of upwardly converging canted surfaces 34 (FIGS. 4 and 5) are provided at the bottom of the slot. The canted surfaces 34 are inclined upwardly and inwardly and in the case of a paint brush handle of solid material (FIGS. 1 and 4), define a crown 36 at the central axis of the brush handle. In the case of a hollow handle (FIG. 5), the canted surfaces 34 do not meet because of the hollow cavity 40 on the interior central axis of the paint brush handle. With the canted surface thus defined, removal of the paint brush from the hanging arm 16 is greatly facilitated.

For example, as shown in section in FIG. 1, as a paint brush 12 is canted relative to the hanging arm member 16, the canted surfaces 34 prevent binding which would normally occur at the bottom edges of a slot 28 having a flat bottom. The crown 36 primarily engages the cantilever arm 16 and, due to the minimal friction and binding between the crown and arm, provides for great ease of movement of the brush off of the arm. Therefore, the removal of a paint brush will be greatly facilitated since there will be no binding against the sliding movement of the paint brush relative to the hanging cantilever arm member 16. The canted surfaces 34 work equally well with a solid handle (FIG. 4) or a hollow handle (FIG. 5) to alleviate the binding problem. With the hollow handle of FIG. 5, the surfaces 34 each terminate in sharp crowns 50, similar to the single crown 36 of the solid handle shown in FIG. 4.

In an attempt to define the particular angle at which the canted surfaces 34 should be cut to optimize their performance, reference is made to FIG. 1. For a cantilever hanging arm having a width $b$ as shown, a slot having a height $s$, and distance $d$ between locking points, the maximum angle which the handle will go through before binding occurs is defined as the angle $2x$. Therefore, the angle of the canted surface 34, defined as the angle $y$, must be greater than the critical angle $x$ in order for the structure to be effective. Using trigonometry and the Pythagorean theorem we can set up the following relationship between the variables.

$$\sin x = \frac{s}{\sqrt{s^2 + \left[d + \frac{b}{\sin} x\right]^2}}$$

Using algebra we find:

$$\sin x = -db \pm s\frac{\sqrt{d^2 + s^2 - b^2}}{s^2 + d^2}$$

Solving for $x$:

$$x = \sin^{-1}\left[\frac{-db + s\sqrt{d^2 + s^2 - b^2}}{s^2 + d^2}\right]$$

The negative root of the radical is neglected since it can be shown that it leads to negative solutions. Substituting the values of $d$, $s$ and $b$ in the last equation, we can solve for the angle $x$. Then, the angle of the canted surface 34, angle $y$, must be slightly greater than the angle $x$ for the structure to be effective as shown in FIG. 1.

It should be understood that the canted surfaces 34 are equally applicable for use of tools, such as paint brushes, for hanging displays on arms (such as 16) which are square, rectangular, round, etc., in addition to the vertical flat arm shown in FIGS. 1 and 2.

The foregoing detailed description has been given for clearness of understanding only and no unnecessary limitations should be understood therefrom as some modifications will be obvious to those skilled in the art.

We claim:

1. An improvement in a tool handle having a slot for supporting the tool on an elongated cantilever hanger arm of a cross-sectional shape generally complementary to the shape of said slot, the improvement comprising:

a crown defined by two flat, inwardly and upwardly directed surfaces formed at the bottom of the slot to prevent engagement of the edges of the slot at the bottom thereof with the cantilever hanger arm to prevent binding when the tool is canted with respect to the hanger arm during mounting thereon and removal therefrom.

2. A handle for a tool or the like for supporting the tool on a generally vertically flat, horizontally extending cantilever arm, comprising:

a vertical slot in the tool handle adapted to slidably engage the cantilever arm; and a pair of flat inwardly and upwardly converging canted surfaces formed at the bottom of the slot to prevent engagement of the bottom edges of the slot with the arm as the tool is canted relative to the cantilever arm during mounting and removal to prevent binding and to facilitate relative sliding movement between the handle and the cantilever arm.

3. The tool handle of claim 2 wherein the tool handle is solid throughout and the canted surfaces terminate at a crown at the interior center of said slot.

4. The tool handle of claim 2 wherein said handle is generally hollow having walls bounding said slot, said walls at the bottom of said slot having edges which are bevelled so as to be canted inwardly and upwardly toward the hollow interior of the handle.

5. The tool handle of claim 2 including a generally circular aperture at the upper end of said vertical slot and in communication therewith to define a generally "keyhole" shaped slot to permit the handle to slidably engage and be supported by both of said vertically flat cantilever arms as well as a circular cross-sectional arm.

6. A tool handle and cantilever hanging support comprising, in combination:

a cantilever support arm extending outwardly from a suitable supporting surface, said support arm comprising a generally flat, vertically oriented arm member;

a vertical slot in the tool handle adapted to slidably engage the cantilever support arm to maintain vertical alignment of the tool handles and relative alignment between a plurality of tool handles; and a pair of flat inwardly and upwardly canted converging surfaces formed at the bottom of the slot to prevent binding by preventing engagement of the edges of the slot at the bottom thereof with the cantilever arm as the tool is canted relative to the cantilever arm during mounting or removal to facilitate relative sliding movement between the handle and the cantilever arm.

7. The tool handle of claim 6 wherein the tool handle is solid throughout and the canted surfaces terminate at a crown at the interior center of the slot.

8. The tool handle of claim 6 wherein said handle is generally hollow having walls bounding said slot, said walls at the bottom of said slot having edges which are bevelled so as to be canted inwardly and upwardly toward the hollow interior of the handle.

9. The tool handle of claim 6 including a generally circular aperture at the upper end of said vertical slot and in communication therewith to define a generally keyhole shaped slot to permit the handle to slidably engage and be supported by both said vertically flat cantilever arms as well as a circular cross-sectional arm.

* * * * *

UNITED STATES PATENT AND TRADEMARK OFFICE

CERTIFICATE OF CORRECTION

PATENT NO. : 4,060,215

DATED : November 29th, 1977

INVENTOR(S) : Fredrick B. Burns et al

It is certified that error appears in the above-identified patent and that said Letters Patent are hereby corrected as shown below:

On the cover sheet of the patent, with the line starting "[73] Assignee:" E Z PAINTER should be -- E Z PAINTR --.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*